US005156036A

United States Patent [19]

Michaels

[11] Patent Number: 5,156,036

[45] Date of Patent: Oct. 20, 1992

[54] METHOD AND APPARATUS FOR DRAWING OPEN-SIDED CHANNEL MEMBERS

[75] Inventor: Gordon J. Michaels, Trout Run, Pa.

[73] Assignee: Ulrich Copper, Inc., Kenilworth, N.J.

[21] Appl. No.: 747,034

[22] Filed: Aug. 19, 1991

[51] Int. Cl.[5] ..... B21C 3/02

[52] U.S. Cl. ..... 72/285; 72/283; 72/467

[58] Field of Search ..... 72/283, 285, 276, 467, 72/264, 269, 260

[56] References Cited

U.S. PATENT DOCUMENTS

| | | | |
|---|---|---|---|
| 1,004,083 | 9/1911 | Ritter | 72/283 |
| 1,914,997 | 6/1933 | LaBrie | 72/283 |
| 1,979,430 | 11/1934 | Wright | 72/276 |
| 2,231,336 | 2/1941 | Heron | 72/260 |
| 2,335,939 | 12/1943 | Hill . | |
| 2,355,734 | 5/1943 | Katz . | |
| 3,494,165 | 2/1970 | Preusch . | |
| 3,961,515 | 6/1976 | Schmale | 72/467 |
| 4,856,703 | 8/1989 | Uhlmann | 72/283 |
| 4,876,869 | 10/1989 | Saeki et al. | 72/283 |

FOREIGN PATENT DOCUMENTS

| | | | |
|---|---|---|---|
| 191307 | 9/1964 | Sweden | 72/467 |

*Primary Examiner*—Daniel C. Crane
*Attorney, Agent, or Firm*—Marvin A. Naigur

[57] ABSTRACT

Method and apparatus for minimizing or eliminating die breakage when performing a drawing operation on an open-sided channel member. A drawing die has an insert portion that includes a discrete element mounted for transverse movement with respect to the drawing direction. During a drawing operation, the discrete element is allowed to move transversely with respect to the remainder of the drawing die in response to variations in the drawing force transmitted to the discrete element through the channel member being drawn.

10 Claims, 5 Drawing Sheets

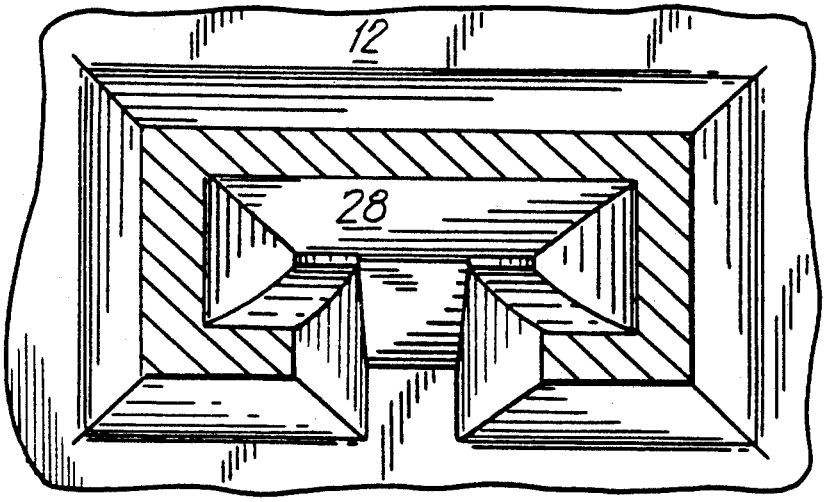
FIG. 6
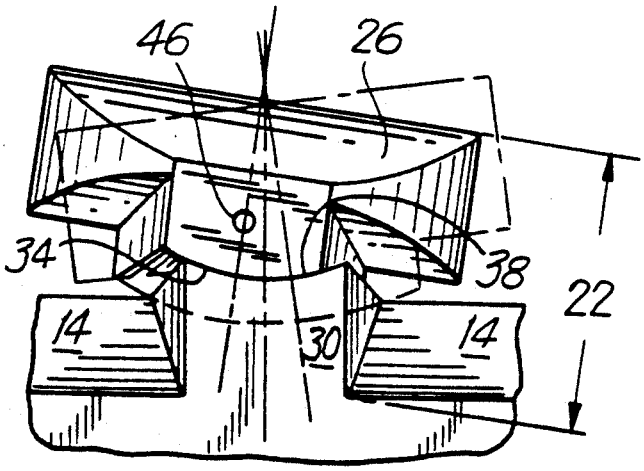
FIG. 7
FIG. 8
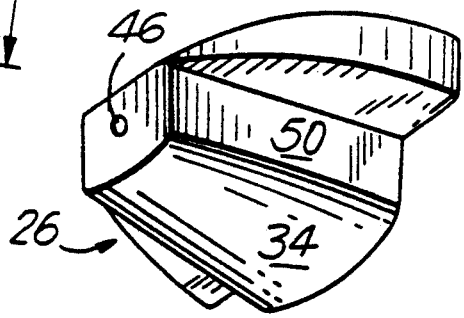
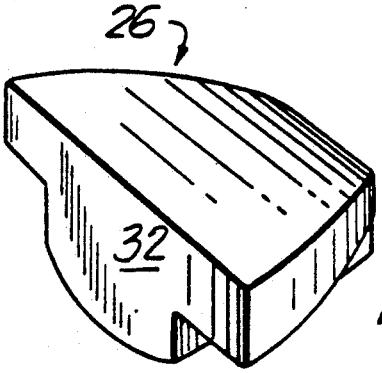
FIG. 9

METHOD AND APPARATUS FOR DRAWING OPEN-SIDED CHANNEL MEMBERS

FIELD OF THE INVENTION

The current invention relates to performing a drawing operation on an open-sided channel member and, in particular, to addressing the problem of die breakage that is characteristic of drawing open-sided channel members.

BACKGROUND OF THE INVENTION

It has been known to perform drawing operations on various shapes of open-sided channel members by pulling a channel through a draw die in which the draw die is provided with a member that extends into the drawing passage to contact and shape interior surfaces of the channel member while the outer surfaces of the channel member are being shaped by outer forming surfaces of the draw die.

A difficulty that has been encountered in the past with such operations arises from varying, unbalanced, or laterally-directed components of generally longitudinal forces used to pull the channel member. The problem arises when the drawing force is transmitted through the member being drawn to that portion of the die that is disposed in contact with the interior surfaces of the channel member. Undesirable components of the force can result in loadings on the insert that cause it to snap off from the remainder of the apparatus.

SUMMARY OF THE INVENTION

The current invention provides a method whereby the apparatus can accommodate the above-mentioned loadings. In particular, at least a portion of the insert is constructed as a separate, discrete element which is mounted to move transversely of the direction of drawing. Therefore, that portion of the apparatus experiencing lateral loadings actually is able to move in response to them. In this manner, the apparatus is saved from breakage.

In particular, there is provided a method of performing a drawing operation on an open-sided channel member using a drawing die having an insert portion comprising a discrete element mounted for transverse movement with respect to the drawing direction. During a drawing operation, the discrete element is allowed to move transversely with respect to the remainder of the drawing die in response to the instantaneous character of the drawing force transmitted to the discrete element through the channel member being drawn.

It will be understood from the disclosure as a whole that the word "transversely" is used in contrast to "longitudinally" and to refer to motion in a transverse plane. In some embodiments of the invention, such transverse motion might be linear. In the disclosed and presently preferred embodiment, the motion is rotational.

Also according to the current invention, there is provided apparatus for drawing an open-sided channel member comprising a draw die main body having a drawing passage defined by outer forming surfaces configured to shape outer surfaces of a channel member and by an insert configured to shape inner surfaces of a channel member. The insert comprises at least a support and a discrete element in the form of a floating member. The support is fixed and extends transversely inwardly with respect to the drawing passage. It serves to hold the floating member at a pre-determined longitudinal location during a drawing operation. The floating member is a separate element mounted for transverse movement in response to forces transmitted to it through the channel member being drawn.

The current invention is suitable for drawing open-sided channel members having a wide range of shapes. Two examples are shown in the drawings, illustrating that the invention is applicable to channel members having partially closed sides and completely open sides, also showing that the invention is applicable to channel members having aspect ratios such that they might be described as shallow and deep, respectively.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accord with the present invention when taken in conjunction with the accompanying drawings wherein:

FIG. 6 is a fragmentary rear elevation of the first embodiment, taken along line 6—6 of FIG. 2;

FIG. 7 is a front elevation of an insert according to the first embodiment, also showing nearby outer forming surfaces partially broken away;

FIGS. 8 and 9, respectively, are a front lower right perspective and a rear upper left perspective of a floating member according to the first embodiment;

DESCRIPTION OF THE PREFERRED EMBODIMENTS

Figure 1:
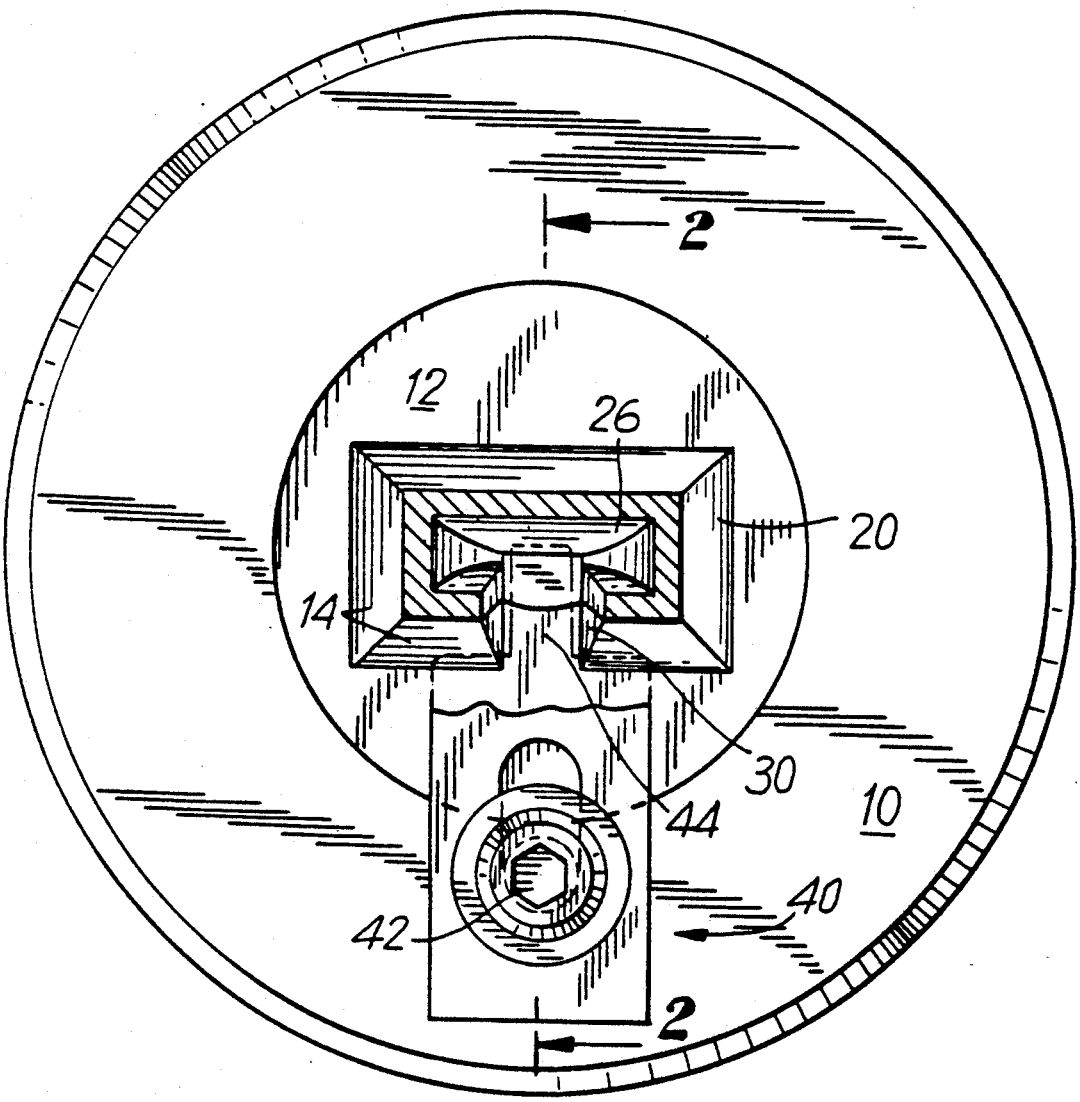
FIG. 1 is a front elevation of a first embodiment according to the current invention and showing in section an open-sided channel member having a partially closed side.
Figure 2:
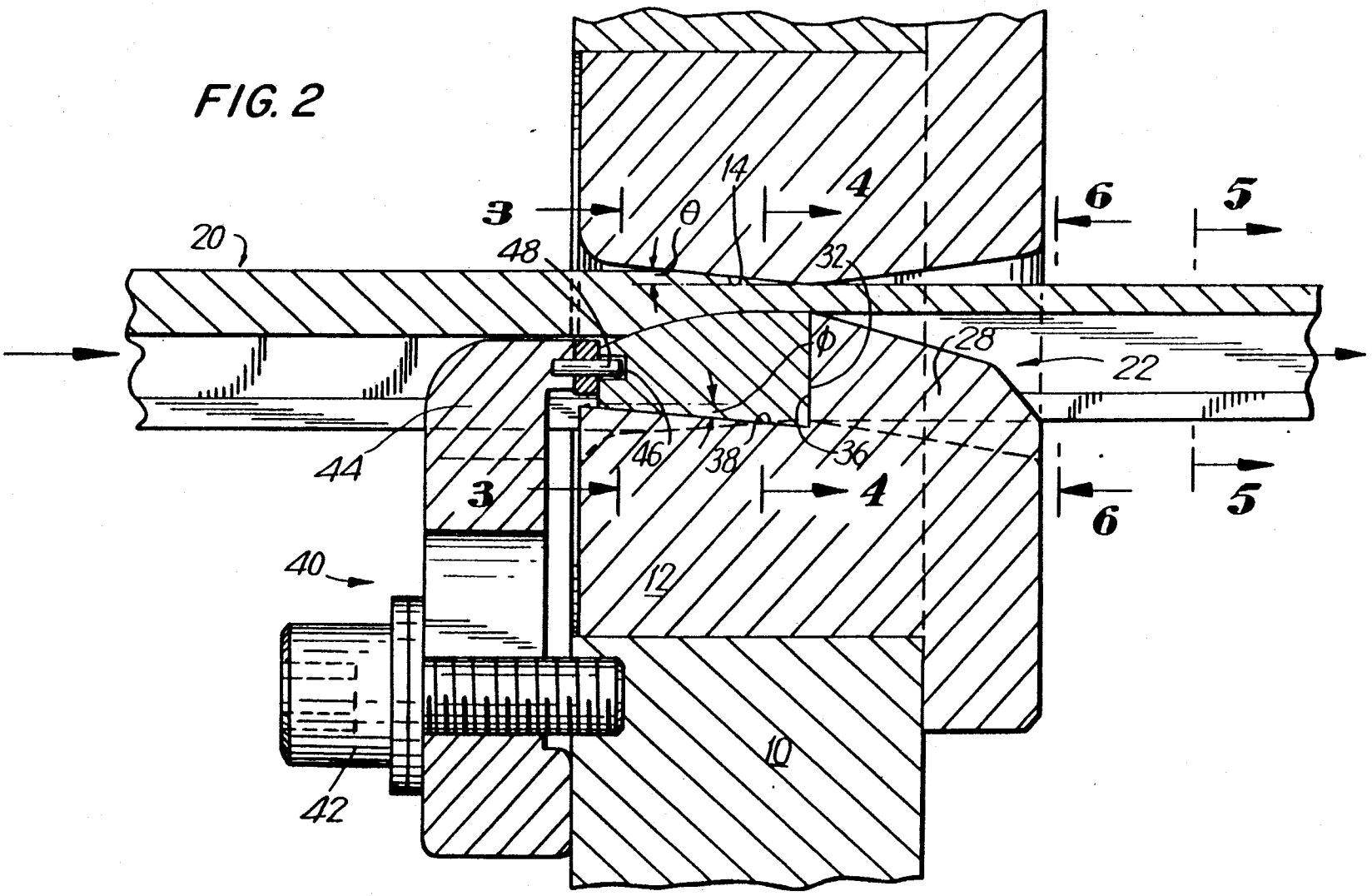
FIG. 2 is a fragmentary cross-sectional elevation taken along line 2—2 of FIG. 1.
Figure 3:
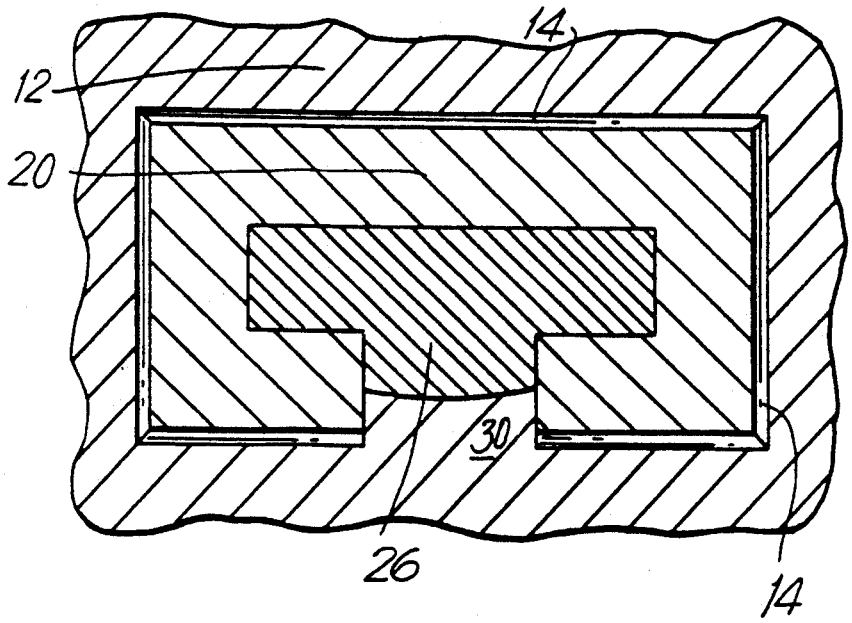
FIG. 3 is a cross-sectional elevation taken along line 3—3 of FIG. 2 and showing a channel member at the point of first contact with the floating member.
Figure 4:
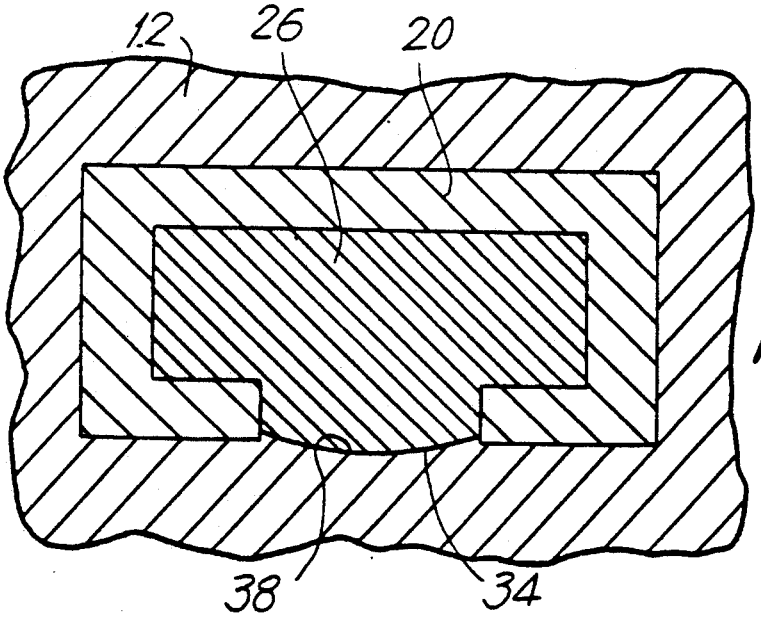
FIG. 4 is a cross-sectional elevation taken along line 4—4 of FIG. 2.
Figure 5:
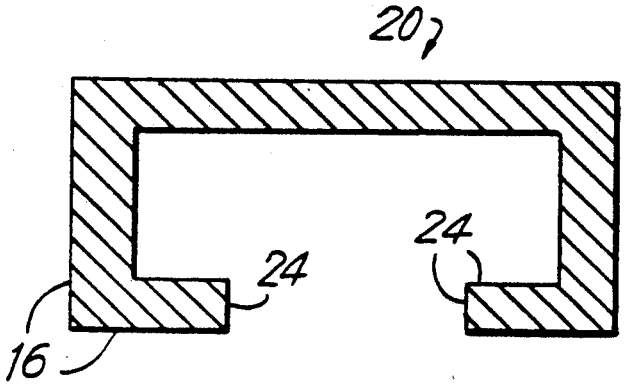
FIG. 5 is a cross-sectional elevation taken along line 5—5 of FIG. 2 and showing the post-drawing shape of an open-sided channel member having a partially closed side.

FIGS. 1 and 2 show a first embodiment of a draw die including a main body made up of a case 10 and a die holder 12. Firmly held within the die holder is a die 13 formed from carbide or the like. Outer forming surfaces 14 of the die slope inwardly at a lead angle $\Theta$ for progressively shaping the outer surfaces 16 (FIG. 5) of an open-sided channel member 20 being drawn. Thereafter, the outer surfaces of the die diverge toward the rear face of the die.

An insert 22 (also see FIG. 7) extends transversely inwardly from the location of two of the outer forming surfaces. The insert is configured to shape inner surfaces 24 (FIG. 5) of a channel member being drawn. In this embodiment the channel member being drawn has a partially closed side, so the insert has a transverse cross-section broadly resembling a "T."

The characteristics of the apparatus described above are conventional and are subject to the breakage problem described in more detail in the Summary of the Invention.

According to the current invention, the insert comprises a discrete element in the form of a floating member 26 that is mounted for transverse movement in response to forces imparted to it through the channel member being drawn. As best seen in FIG. 2, the insert further comprises a support 28 extending transversely inwardly and serving to provide a support for the floating member 26 to restrain it against longitudinal movement in the drawing direction. The support may be integral with the adjacent portion of the die.

FIG. 6 shows a rear view of the die and of the support 28. As shown, it is desirable that the surfaces of this rearward portion of the apparatus slope away from the member being drawn in order to avoid interference.

As best seen in FIG. 7, the insert 22 in this embodiment also includes a lateral member 30 extending transversely inwardly from the location of two of the outer forming surfaces 14 to provide lateral support for the floating member 26.

Now with additional reference to FIGS. 8 and 9, the floating member 26 defines a rear bearing surface 32 and a lateral bearing surface 34 that respectively cooperate with a rear bearing surface 36 (FIG. 2) formed on the forward face of the support 28 and a lateral bearing surface 38 formed on the lateral member 30 of the insert. It will be understood that, through these cooperating bearing surfaces, the floating member is mounted for movement with respect to the support and the rest of the apparatus. It will further be understood that the bearing surfaces define a pre-determined path of movement of the floating member.

It is desirable for the lateral bearing surfaces to slope away from the drawing passage in the direction of drawing. Such a slope is indicated by the angle $\Phi$ in FIG. 2. It is further desirable for the magnitudes of the angles $\Theta$ and $\Phi$ to be approximately equal. In the presently preferred embodiment, both $\Theta$ and $\Phi$ are about ten degrees.

It is further preferred for the rear bearing surfaces and lateral bearing surfaces to be curved. FIG. 7 schematically illustrates in greatly exaggerated fashion the nature of the movement of the floating member that can result when the lateral bearing surfaces are curved. As explained in more detail in the Summary of the Invention, such movement is termed "transverse" herein, even though it is rotational.

FIGS. 1 and 2 show an optional restraining member 40 removably mounted as by a bolt 42 to a convenient section of the main body of the die. The restraining member 40 includes an arm 44 extending transversely inwardly into the interior of the incoming portion of the open-sided channel member 20. A distal end of the arm extends longitudinally in the drawing direction and terminates at a point either in contact with or just forward of the floating member 26.

The restraining member serves no function during the time when an open-sided channel member is moving through the die. At such times, the force of drawing firmly seats the floating member 26 against the support 28 and the lateral bearing surface 38. However, when the drawing operation is finished and the drawing force is relieved, the apparatus as a whole may experience some rebound. In such event, it is convenient to have a way of restraining the floating member from the exiting the die. This function may be performed by the restraining member.

It is further desirable to limit the extent of movement of the floating member 26. To this end, and as shown in FIG. 2, the forward face (or other appropriate portion) of the floating member 26 may be provided with an opening 46 that receives a stop 48 fixedly mounted to an adjacent portion of the apparatus, such as the restraining member 40. The diameter of the opening 46 is oversized with respect to the diameter of the stop 48. It will be understood that the differences in these diameters will govern the length of travel permitted the floating member 26. In the illustrated embodiment, it is appropriate for the diameter of the opening 46 to be about 0.010 inch greater than that of the stop 48 when drawing a copper channel having outside dimensions of approximately three inches by about one and one-half inch.

In operation, an open-sided channel member 20 to be drawn is disposed in the drawing passage with the floating element 26 in contact with five of the interior surfaces 24 of the channel member that define the inside rectangular shape, and with the appropriate side walls 50 of both the floating member 26 and the lateral support 30 of the insert in contact with the two interior surfaces 24 of the channel member that are disposed between the previously recited interior surfaces and the exterior surfaces 16.

A longitudinal drawing force is applied to the channle member to pull it through the die in a drawing direction as indicated by arrows in FIG. 2. During the drawing operation, the floating member 26 shapes the inside surfaces of the channel member and, in so doing, is allowed to move with respect to the remainder of the apparatus in response to the instantaneous character of the drawing force transmitted to it through the channel member being drawn.

Figure 10:
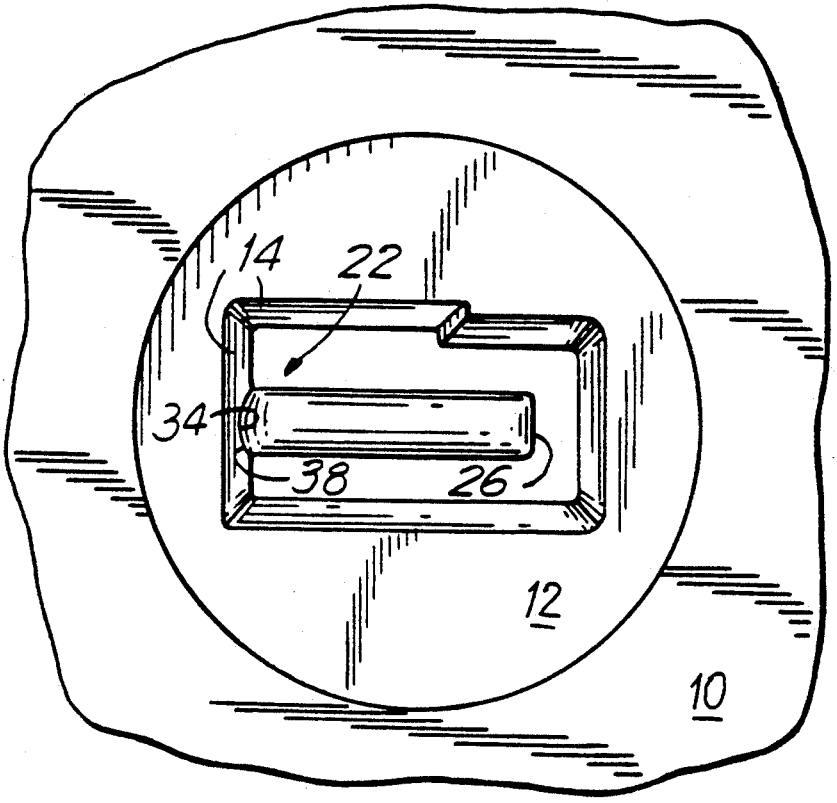
FIG. 10 is a front elevation of a second embodiment according to the current invention, being suitable for drawing an open-sided channel member having a completely open side.
Figure 11:
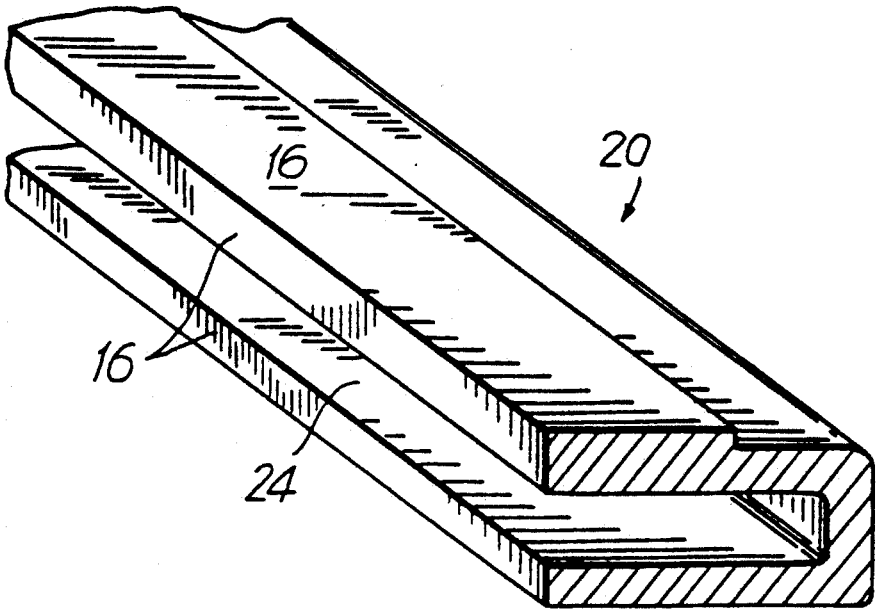
FIG. 11 is a perspective, partly in cross-section of an open-sided channel member having a completely open side.

FIGS. 10 and 11 represent a second embodiment in which the channel member being drawn has a fully open side. For clarity, the restraining member 40 is not shown.

The principal structural and functional differences between the first and second embodiments relate to the absence in the completely open-sided channel member of inwardly extending legs like those that serve to partially close the side of the first embodiment. Accordingly, the insert of the second embodiment is substantially elongate rather than having a T-shaped cross-section. For the same reason, the lateral bearing surface 38 of the insert is disposed at or near the adjacent outer forming surfaces 14.

A latitude of modification, change and substitution is intended in the foregoing disclosure and in some instances some features of the invention will be used without a corresponding use of other features. Accordingly, it is appropriate that the appended claims be construed broadly and in a manner consistent with the scope of the invention therein.

What is claimed is:

1. A method of performing a drawing operation on an open-sided channel member comprising the steps of:

providing a drawing die having a drawing passage configured to receive and shape an open-sided channel member, including an insert portion comprising a discrete non-spherical element mounted for transverse movement with respect to a drawing direction;

disposing in the drawing passage an open-sided channel member to be drawn;

disposing the discrete element and interior surfaces of the channel member in contact;

applying a longitudinal drawing force to the channel member to pull it through the die in the drawing direction;

during the drawing operation, using the discrete element to shape inside surfaces of the channel member;

during the drawing operation, allowing the discrete non-spherical element to move transversely with respect to the remainder of the drawing die in response to the instantaneous character of the drawing force transmitted to the discrete element through the channel member being drawn.

2. The method of claim 1, further including the step of using means extending into the open side of the channel member to restrain the discrete element from undergoing substantial movement in the drawing direction during the drawing operation.

3. Apparatus for drawing an open-sided channel member comprising:

a draw die main body having formed therein a drawing passage configured for the drawing of an open-sided channel member, the passage being defined by outer forming surfaces configured to shape outer surfaces of a channel member and by an insert, the insert comprising a support and a floating member and being configured to shape inner surfaces of a channel member, the support being fixed with respect to the draw die main body and extending transversely inwardly from the outer forming surfaces, the support comprising means for holding the floating member at a pre-determined longitudinal location during a drawing operation of an open-sided channel member, the floating member being a discrete non-spherical element mounted for transverse movement with respect to the support during a drawing operation and in response to forces transmitted to it through the channel member being drawn.

4. The apparatus of claim 3, comprising cooperating lateral bearing surfaces respectively formed on the floating member and on an immediately-adjacent section of the insert, the lateral bearing surfaces extending generally longitudinally and transversely of the die.

5. The apparatus of claim 4, wherein the lateral bearing surfaces are curved.

6. The apparatus of claim 4, wherein the lateral bearing surfaces slope away from the drawing passage in a direction of drawing.

7. The apparatus of claim 3, comprising cooperating rear bearing surfaces respectively formed on the floating member and on an immediately-adjacent section of the support, the rear bearing surfaces extending generally transversely of the die.

8. The apparatus of claim 7, wherein the rear bearing surfaces are curved.

9. The apparatus of claim 3, comprising stop means for limiting the extent of transverse motion of the floating member, the stop means being fixed with respect to the draw die main body and extending into an oversized opening in the floating member.

10. The apparatus of claim 3, comprising a restraining member disposed generally forward of the floating member and preventing the floating member from exiting the draw die main body when the pressure of a drawing operation is relieved.

* * * * *